United States Patent [19]

Honma

[11] 4,402,284

[45] Sep. 6, 1983

[54] INTERNAL COMBUSTION ENGINE ROCKER ARM ARRANGEMENT HAVING A READILY REPLACEABLE PLATE SPRING

[75] Inventor: Masayuki Honma, Tokyo, Japan

[73] Assignee: Nissan Motor Company, Ltd., Yokohama, Japan

[21] Appl. No.: 238,572

[22] Filed: Feb. 26, 1981

[30] Foreign Application Priority Data

Mar. 3, 1980 [JP] Japan ..... 55-26153[U]

[51] Int. Cl.[3] ..... F01L 1/18

[52] U.S. Cl. ..... 123/90.39

[58] Field of Search ..... 123/90.39, 90.41, 90.44

[56] References Cited

U.S. PATENT DOCUMENTS

| | | | |
|---|---|---|---|
| 2,298,981 | 10/1942 | Smith | 123/90.39 |
| 2,982,273 | 5/1961 | Bergmann | 123/90.39 |
| 3,138,146 | 6/1964 | Hutchison | 123/90.39 |
| 3,150,648 | 9/1964 | Gropp | 123/90.39 |
| 3,270,727 | 9/1966 | Nance | 123/90.39 |
| 3,841,280 | 10/1974 | Lussier | 123/90.39 |
| 4,182,289 | 1/1980 | Nakajima et al. | 123/90.39 |

FOREIGN PATENT DOCUMENTS 861598 2/1961 United Kingdom .

*Primary Examiner*—Craig R. Feinberg
*Assistant Examiner*—W. R. Wolfe
*Attorney, Agent, or Firm*—Schwartz, Jeffery, Schwaab, Mack, Blumenthal & Koch

[57] ABSTRACT

A plate spring is formed to have a "spider-like" configuration with pairs of bent "spider leg-like" flexible fingers. The spring is fixed to the top of a rocker arm shaft mounting bracket so that each pair of fingers straddles the rocker arm shaft and biasingly contacts a lateral surface of a rocker arm pivotally mounted on said shaft. The fingers have a length adequate to allow for mass production tolerances while simultaneously biasing the rocker arm uniformly along the rocker arm shaft preventing any unwanted uneven wearing of the shaft or rocker arm. The spring may be replaced simply by removing a single bolt.

3 Claims, 5 Drawing Figures

INTERNAL COMBUSTION ENGINE ROCKER ARM ARRANGEMENT HAVING A READILY REPLACEABLE PLATE SPRING

BACKGROUND OF THE INVENTION

1. Field of the Invention

The present invention relates generally to an internal combustion engine and more particularly to a rocker arm arrangement for same which features a readily replaceable plate spring.

2. Description of the Prior Art

In known arrangements such as illustrated in FIGS. 1 and 2 of the drawings, in order to maintain the rocker arms in a suitable position, coil springs have been disposed about a fixedly mounted rocker arm shaft to bias the rocker arm or arms to a desired position. However, this arrangement has suffered from the drawbacks that in order to allow for the large mass production variation which is apt to occur between springs of relatively short length it has been necessary to utilize long springs which accordingly require wide gaps for same between the rocker arm or arms and a fixed abutment member against which the other end of the spring abuts. Further, as the spring is disposed about the rocker arm shaft, considerable time and effort is required to install the spring during initial assembly and/or during replacement of a broken or worn spring.

SUMMARY OF THE INVENTION

It is an object of the present invention to provide a rocker arm arrangement featuring a plate spring which is sufficiently long as to allow for mass production tolerances, and hence be producible so that from unit to unit, substantially the same biasing force will be applied against the rocker arm and which is readily removable from the rocker arm arrangement without the need of disassembly of the whole arrangement.

The present invention features a "spider-like" plate spring which is fixed via a single bolt to the top of or on other accessible site of a rocker arm supporting bracket. The plate spring has in the preferred embodiment, two pairs of bent fingers, resembling spider legs, which spacedly staddle the rocker arm shaft and abut the lateral surface of a rocker arm. The fingers are curved in either or both of the longitudinal or latitudinal directions thereof, so that at the point of contact with the rocker arm a point or line contact is defined. This of course simultaneously biases the rocker arm along the rocker arm shaft while minimizing frictional interference therebetween. As the spring is secured to an accessible site by a single bolt, replacement of same is extremely easy. The arrangement further markedly reduces the space wasting gaps normally necessary for the coil type springs.

BRIEF DESCRIPTION OF THE DRAWINGS

The features and advantages of the arrangement of the present invention will become more cleary appreciated from the following description taken in conjunction with the accompanying drawings in which like reference numerals denote corresponding elements, and in which.

DETAILED DESCRIPTION OF THE PREFERRED EMBODIMENTS

Figure 1:
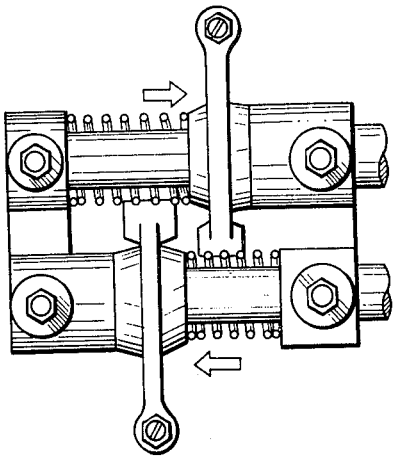
FIG.1 (PRIOR ART)
FIG. 1 is a plan view of a prior art arrangement discussed briefly under the heading of "Description of the Prior Art"
Figure 2:
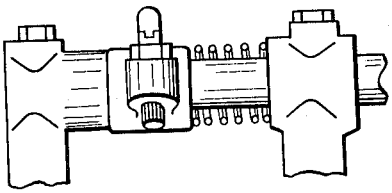
FIG.2 (PRIOR ART)
FIG. 2 is an elevational view of the arrangement shown in FIG. 1.
Figure 3:
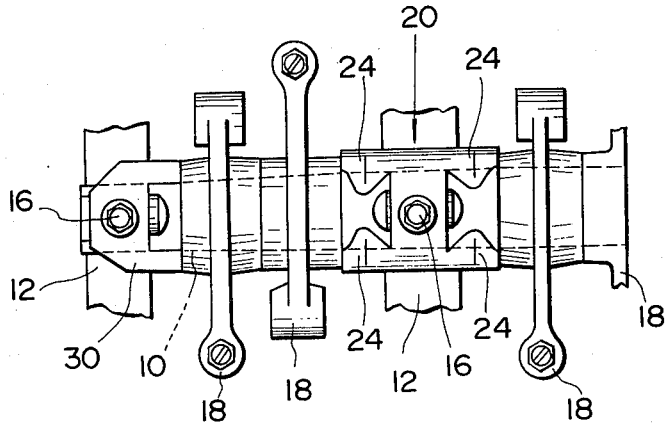
FIG. 3 is a plan view of a preferred embodiment of the present invention.
Figure 4:
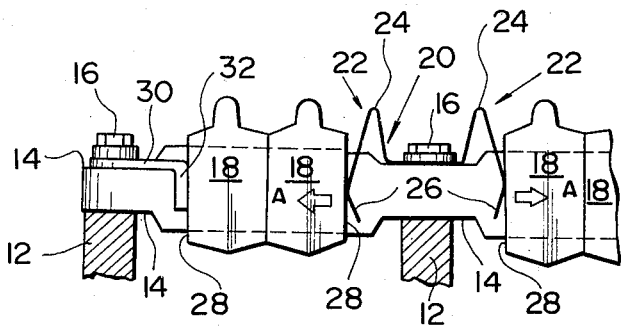
FIG. 4 is an elevational view of the arrangement shown in FIG. 3.
Figure 5:
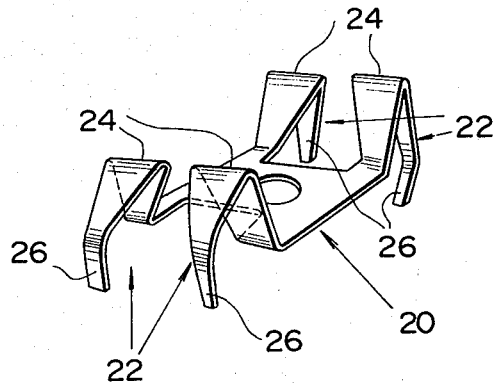
FIG. 5 is a perspective view of the "spider-like" spring which characterizes the preferred embodiment.

Turning now the the drawings and more specifically to FIGS. 3 to 5, a preferred embodiment of the present invention is shown. In this arrangement a rocker arm shaft 10 is securely mounted to a cylinder head (not shown) via mounting brackets 12 which may be fastened to or formed integrally with the cylinder head. To facilitate the rigid connection of the rocker arm shaft 10 to the mounting brackets 12, flat surfaces 14 are formed on the shaft and bolts 16 disposed therethrough and threadedly received in threaded bores formed in the mounting brackets.

In the preferred embodiment in order to utilize the available space most effectively, pairs of rocker arms 18 are rotatably or oscillatably mounted on the shaft on either side of the mounting bracket on which the "spider-like" plate spring 20 is fixed via a bolt 16.

As best shown in FIG. 5 the plate spring 20 has two pairs of "spider leg"-like fingers 22. Each of the fingers has an acutely bent portion 24 and a curved appendage 26 depending therefrom. The appendages may be curved in either or both of the longitudinal direction and latitudinal direction thereof. In the case that each appendange is curved in one direction only, be it the longitudinal direction or latitudinal direction, a line contact will be established with a lateral side 28 of the rocker arm against which the spring applies force while, in the case where the appendages are curved in both directions, a point contact will be established.

In order to appropriately locate the rocker arms on the rocker arm shaft it is preferable to fix a thrust receiver or receivers 30 on mounting brackets adjacent that on which the plate spring 20 is mounted so as to abut a lateral side 28 of the one of the pair of rocker arms.

Each of the thrust receivers 30 have downwardly depending leg members 32 which slidingly contact the lateral side 28 of the rocker arm.

From FIG. 4 it will be appreciated that the configuration of the plate spring produces a thrust which acts in the direction of the arrows A and accordingly biases the rocker arms directly and uniformly along the rocker arm shaft without any tendency to twist or the like, which would tend to induce uneven wear of the shaft 10 and the bores in the rocker arms 18 through which the shaft is disposed. This figure highlights the length of each flexible finger 22 which eliminates the problem normally encountered with short springs. The figure further highlights the ease with which the plate spring 20 may be removed from the cylinder via the simple unscrewing of a single bolt.

From FIG. 5 it will be appreciated that the configuration of the plate spring 20 is such as to be readily manufacturable via a simple stamping process from sheets of spring steel. These sheets of course can be produced having relatively uniform spring characteristics which, in combination with the relatively long length of each of the flexible fingers 22, allows ready mass production with an acceptable unit to unit variation.

Thus the invention features a plate spring which via its simple shape permits ready attachment of same to a cylinder head, ready production along with a desirable reduction in space normally required by prior art springs.

What is claimed is:

1. In an internal combustion engine having a cylinder head the combination of:

first, second and third mounting brackets extending from said cylinder head;

a rocker arm shaft removably mounted on said mounting brackets;

first and second rocker arms pivotally mounted on said rocker arm shaft between said first and second mounting brackets;

third and fourth rocker arms pivotally mounted on said rocker arm shaft between said second and third mounting brackets;

a single plate spring having two pairs of bent flexible fingers, said plate spring being detachably mounted on said second mounting bracket so that the first pair of flexible fingers spacedly straddle said rocker arm shaft to contact a lateral side of said first rocker arm and a second pair of flexible fingers which spacedly straddle said rocker arm shaft to contact a lateral side of said third rocker arm, said plate spring being arranged to bias said first and third rocker arms away from said second mounting bracket and into contact with said second and fourth rocker arms; and abutment means extending from each of said first and third mounting brackets toward said second mounting bracket for abutting said second and fourth rocker arms and for maintaining said first and second and third and fourth rocker arms in predetermined positions, said abutment means being connected to and stationary with respect to said first and third mounting brackets.

2. In an internal combustion engine having a cylinder head, the combination of:

a rocker arm shaft detachably mounted to said cylinder head;

a rocker arm pivotally mounted on said rocker arm shaft;

a plate spring detachably fixed to said cylinder head, said plate spring having a pair of bent fingers which spacedly straddle the rocker arm shaft and contact a lateral surface of said rocker arm to bias said rocker arm in one direction along said rocker arm shaft, said bent fingers configured to have an acute bend portion and a curved appendage portion depending therefrom, said curved depending appendage portion contacting said lateral side of said rocker arm, said appendage portion curved in both of the longitudinal and latitudinal directions so as to define a point contact with said lateral side of said rocker arm; and abutment means associated with said rocker arm shaft against which said rocker arm is biased by said bent fingers of said plate spring for locating said rocker arm in a predetermined position.

3. In an internal combustion engine having a cylinder head, the combination of:

a rocker arm shaft detachably mounted to said cylinder head;

a rocker arm pivotally mounted on said rocker arm shaft;

a plate spring detachably fixed to said cylinder head, said plate spring having a pair of bent fingers which spacedly straddle the rocker arm shaft and contact a lateral surface of said rocker arm to bias said rocker arm in one direction along said rocker arm shaft; and a plurality of brackets extending from said cylinder head for mounting said rocker arm shaft, said plate spring removably attached to one of said brackets, abutment means associated with said rocker arm shaft against which said rocker arm is biased by said bent fingers of said plate spring for locating said rocker arm in a predetermined position, said abutment means comprising a thrust receiver extending from another of said mounting brackets toward said one bracket on which said plate spring is attached, and said thrust receiver being connected to and stationary with respect to said plurality of brackets.

* * * * *